US008303283B2

(12) United States Patent
Kim et al.

(10) Patent No.: US 8,303,283 B2
(45) Date of Patent: Nov. 6, 2012

(54) POWER STEERING OIL PUMP

(75) Inventors: Minjung Kim, Hwaseong-si (KR); Yangsoo Lee, Daegu (KR)

(73) Assignees: Hyundai Motor Company, Seoul (KR); Youngshin Precision Co., Ltd., Gyeongju-si (KR)

( * ) Notice: Subject to any disclaimer, the term of this patent is extended or adjusted under 35 U.S.C. 154(b) by 577 days.

(21) Appl. No.: 12/561,026

(22) Filed: Sep. 16, 2009

(65) Prior Publication Data

US 2010/0135838 A1 Jun. 3, 2010

(30) Foreign Application Priority Data

Dec. 3, 2008 (KR) ..... 10-2008-0121876

(51) Int. Cl.
*F03C 4/00* (2006.01)
*F04C 2/00* (2006.01)

(52) U.S. Cl. ..... 418/259; 418/98; 418/260; 418/268

(58) Field of Classification Search ..... 418/88, 418/94, 98, 259, 260, 266–268, 131, 133
See application file for complete search history.

(56) References Cited

U.S. PATENT DOCUMENTS 6,846,163 B2 * 1/2005 Takahashi et al. ..... 418/259
7,546,895 B2 6/2009 Ueki et al.

FOREIGN PATENT DOCUMENTS

| | | | |
|---|---|---|---|
| JP | 7-35053 | A | 2/1995 |
| JP | 9-25809 | A | 1/1997 |
| JP | 2002-147367 | A | 5/2002 |
| JP | 2008-111360 | A | 5/2008 |
| KR | 2003-0031991 | A | 4/2003 |
| KR | 10-2004-0032367 | A | 4/2004 |
| KR | 10-2007-0001358 | A | 1/2007 |
| KR | 10-2008-0081431 | A | 9/2008 |

* cited by examiner

*Primary Examiner* — Theresa Trieu
(74) *Attorney, Agent, or Firm* — Morgan, Lewis & Bockius LLP

(57) ABSTRACT

A power steering oil pump may include a pump housing, a rotor that is equipped with a plurality of vanes and coupled to the pump housing to rotate therein, a cam ring inserted between the rotor and the pump housing to form a pumping space between the cam ring and the rotor, a rotor shaft that passes through the rotor and is fitted therein to transmit rotational force to the rotor, and a bush that has at least a first oil groove on an inner circumference thereof and supports the rotor shaft to a pump cover coupled to the pump housing while covering a portion of the rotor shaft which passes through the rotor, wherein at least a second oil groove is formed on an end portion of the vanes contacting with an inner circumference of the cam ring.

4 Claims, 5 Drawing Sheets

POWER STEERING OIL PUMP

CROSS-REFERENCE TO RELATED APPLICATIONS

The present application claims priority to Korean Application Serial Number 10-2008-0121876, filed on Dec. 3, 2008, the entire contents of which is incorporated herein for all purposes by this reference.

BACKGROUND OF THE INVENTION

1. Field of the Invention

The present invention relates to a power steering oil pump, particularly the structure of a power steering oil pump that can reduce vibration that is transmitted to a driver through a steering wheel.

2. Description of Related Art

Shudder, which is circumferential vibration generated when a steering wheel is operated, is caused by changes of engine torque that is transmitted to the steering wheel through a steering system, and this is considered as an inveterate problem because it is difficult to find a measure to overcome the problem.

In the transmission path of vibration from the engine to the steering wheel, vibration due to the engine torque is transmitted to a belt connected to a power steering oil pump to transmit power and then reaches the steering wheel through a hydraulic hose, a gear box, and a steering shaft.

Therefore, it is required to stop vibration at somewhere before the vibration reaches the steering wheel after the torque is transmitted from the engine in order to prevent the vibration from being transmitted to a driver through the steering wheel.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a power steering oil pump that can improve properties against noise and vibration of a vehicle and commercial value of the vehicle by improving the structure of a power steering oil pump such that vibration due to torque generated by an engine is stopped or reduced without being transmitted to a steering wheel, which a driver holds with hands, through a power steering system.

In an aspect of the present invention, the power steering oil pump may include a pump housing, a rotor that is equipped with a plurality of vanes and coupled to the pump housing to rotate therein, a cam ring inserted between the rotor and the pump housing to form a pumping space between the cam ring and the rotor, a rotor shaft that passes through the rotor and is fitted therein to transmit rotational force to the rotor, and a bush that has at least a first oil groove on an inner circumference thereof and supports the rotor shaft to a pump cover coupled to the pump housing while covering a portion of the rotor shaft which passes through the rotor, wherein at least a second oil groove is formed on an end portion of the vanes contacting with an inner circumference of the cam ring.

Two or more of the second oil grooves may be formed on the end portion of the vanes of the rotor and an oil gallery that is connected to the two or more of the second oil grooves and has a larger volume than each of the two or more of the second oil grooves to receive oil therein is provided in the vanes.

The two or more of the second oil grooves may be formed in parallel each other along a longitudinal direction of the end portion of the vanes.

The at least a first oil groove of the bush may be circumferentially formed at a predetermined distance from each other along the inner circumference of the bush The at least a first oil grooves of the bush may be spirally formed along on the inner circumference of the bush.

In various aspects of the present invention, it is possible to improve properties against noise and vibration of a vehicle and commercial value of the vehicle by improving the structure of a power steering oil pump such that vibration due to torque generated by an engine is stopped or reduced without being transmitted to a steering wheel, which a driver holds with hands, through a power steering system.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
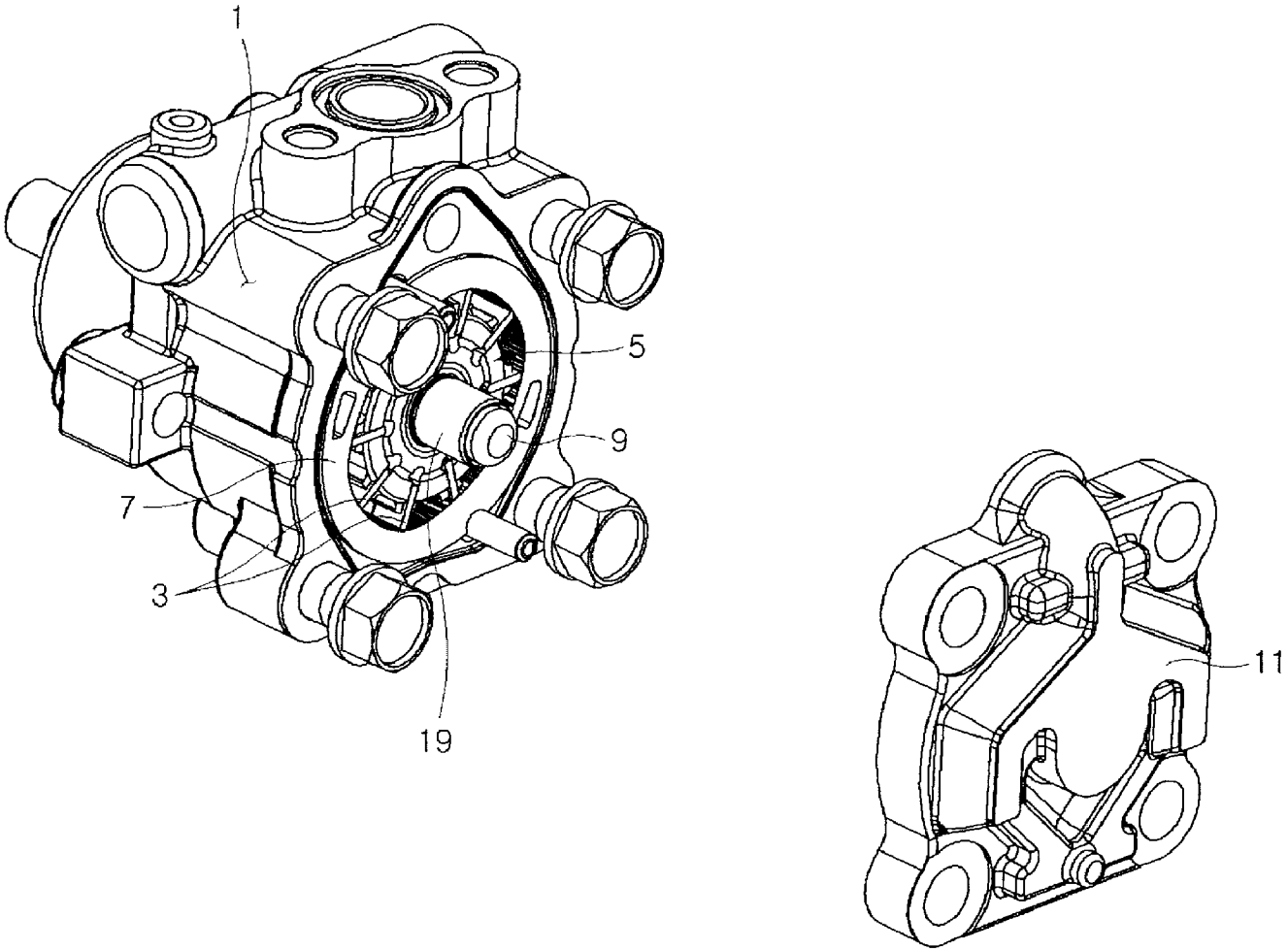
FIG. 1 is a view illustrating the structure of a power steering oil pump, with a pump cover separated, according to an exemplary embodiment of the present invention.
Figure 2:
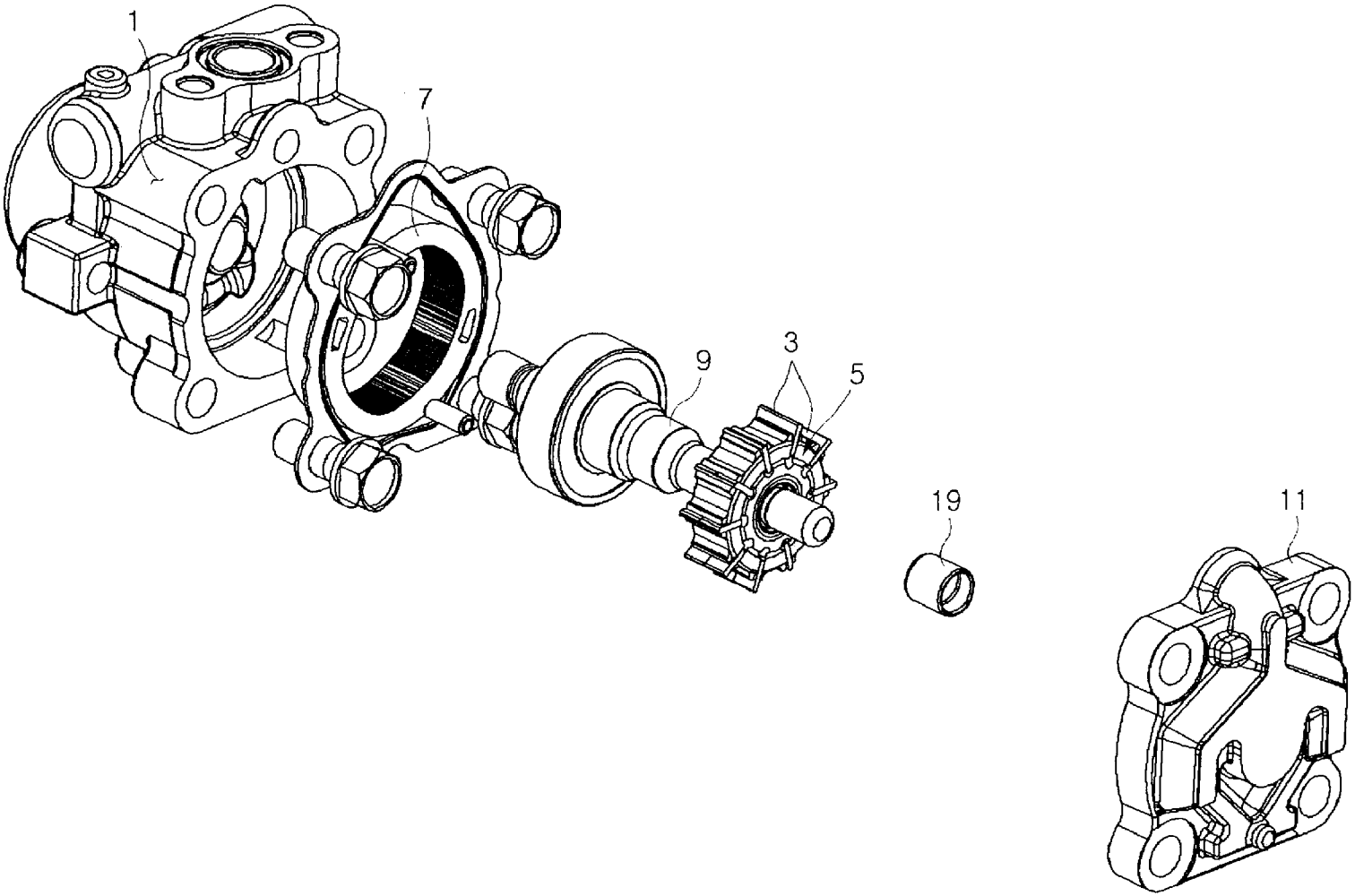
FIG. 2 is an exploded perspective view of the power steering oil pump of FIG. 1.
Figure 3:
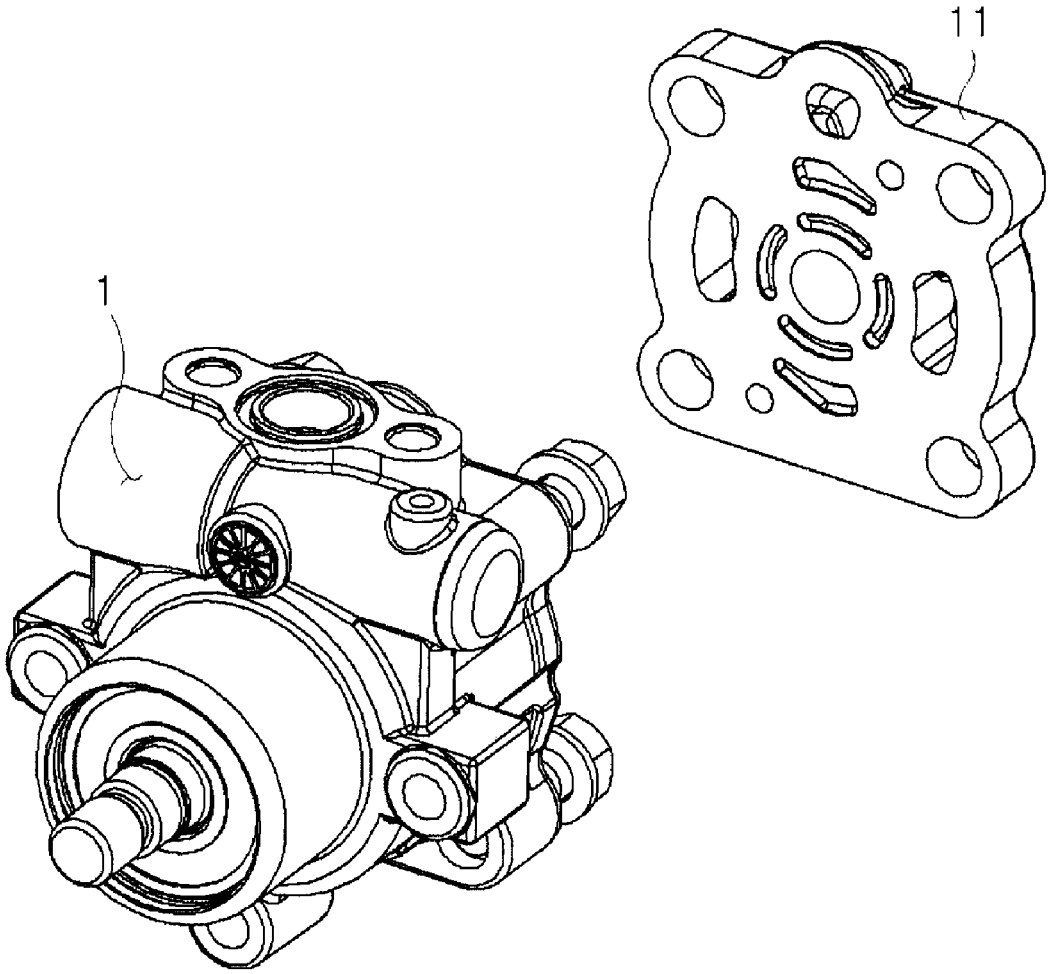
FIG. 3 is a view seen from the opposite direction to FIG. 1.
Figure 4:
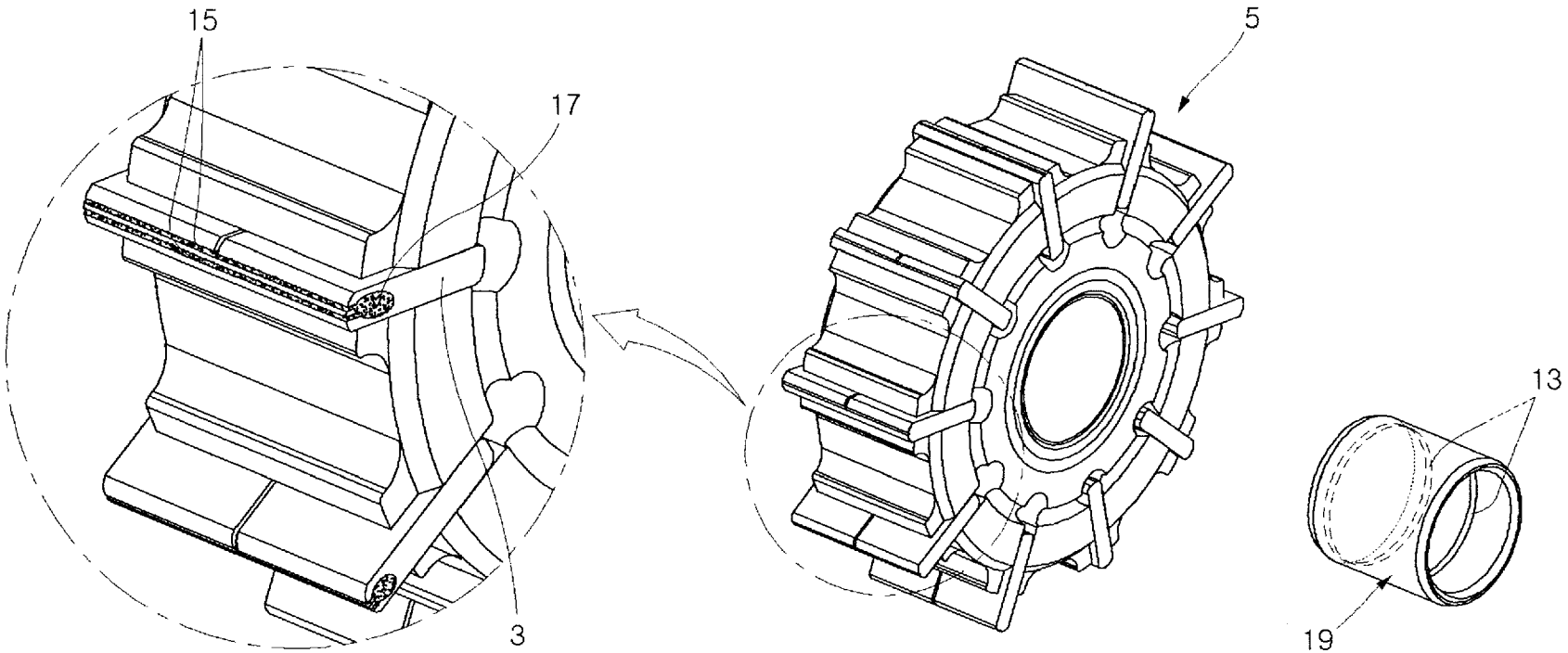
FIG. 4 is a view showing a rotor, vanes, and a bush that are the main parts of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIGS. 1 to 4, a power steering oil pump according to an exemplary embodiment of the present invention includes a pump housing 1, a rotor 5 that is equipped with a plurality of vanes 3 and rotates in pump housing 1, a cam ring 7 that forms a pumping space by being inserted between rotor 5 and pump housing 1, a rotor shaft 9 that passes through rotor 5 and is fitted therein to transmit rotational force to rotor 5, and a bush 19 that has a plurality of oil grooves 13 on the inner circumference and supports rotor shaft 9 to pump cover 11 while covering a portion of rotor shaft 9 which passes through rotor 5, in which long oil grooves 15 are formed on the surfaces contacting with the inner circumference of cam ring 7 at vanes 3 of rotor 5.

In this embodiment, two oil grooves 15 are formed on each of vanes 3 of rotor 5 and an oil gallery 17 that is connected to oil grooves 15 and has a larger volume than oil grooves 15 is further provided.

Oil grooves 13 of bush 19 are circumferentially formed at a predetermined distance from each other on the inner circumference of bush 19.

Figure 5:
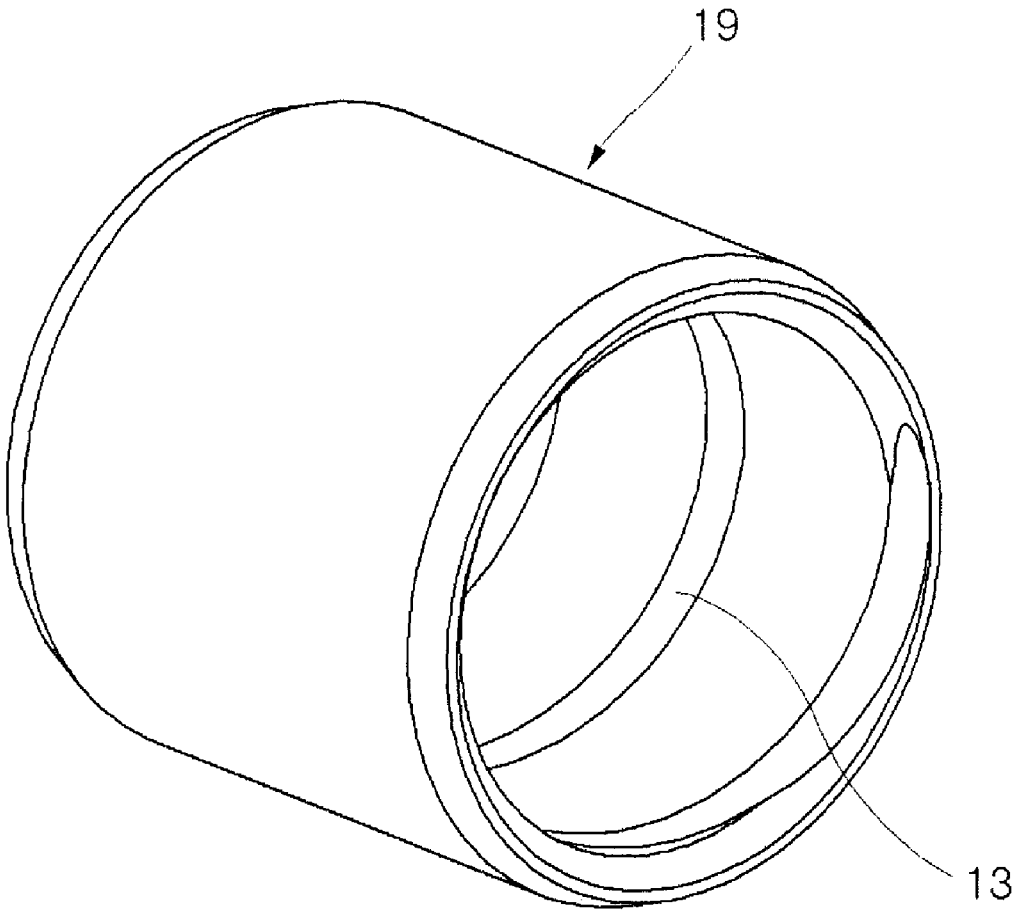
FIG. 5 is a view showing a bush with a spiral groove according to another embodiment of the present invention.

Alternatively, as shown in FIG. 5, oil grooves 13 of bush 19 may be spirally formed circumferentially on the inner circumference of bush 19.

A belt pulley is fitted on the other end of rotor shaft 9 and connected to an engine by a belt, such that it is rotated by power supplied from the engine and rotates rotor 5. Accordingly, as rotor 5 rotates, vanes 3 are operated to pump oil in the pumping space surrounded by the inner circumference of cam ring 7.

In this operation, oil grooves 15 formed on vanes 3 of rotor 5 and oil grooves 13 formed on the inner circumference of bush 19 supporting rotor shaft 9 attenuate and stop rotational vibration transmitted through rotor shaft 9 and rotor 5 from the engine.

That is, direct contact between vanes 3 of rotor 5 and cam ring 7 is prevented by oil films formed by the oil in oil grooves 15 of vanes 3 of rotor 5, such that the vibration is stopped. Further, direct contact is prevented between rotor shaft 9 and bush 19 by oil films formed by the oil stored in oil grooves 13, such that the vibration is attenuated and stopped.

Basically stopping vibration by changing the structure itself of the power steering oil pump can significantly improve the properties against vibration throughout the power steering system, and particularly, the shudder of the steering wheel is prevented or reduced, such that it is possible to provide a driver with improved touch quality and improve commercial value of a vehicle.

For convenience in explanation and accurate definition in the appended claims, the term "inner" is used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof It is intended that the scope of the invention be defined by the Claims appended hereto and their equivalents.

What is claimed is:

1. A power steering oil pump comprising:

a pump housing;

a rotor that is equipped with a plurality of vanes and coupled to the pump housing to rotate therein;

a cam ring inserted between the rotor and the pump housing to form a pumping space between the cam ring and the rotor;

a rotor shaft that passes through the rotor and is fitted therein to transmit rotational force to the rotor; and a bush that has at least a first oil groove on an inner circumference thereof and supports the rotor shaft to a pump cover coupled to the pump housing while covering a portion of the rotor shaft which passes through the rotor;

wherein at least a second oil groove is formed on an end portion of the vanes contacting with an inner circumference of the cam ring; and wherein two or more of the second oil grooves are formed on the end portion of the vanes of the rotor and an oil gallery that is connected to the two or more of the second oil grooves and has a larger volume than each of the two or more of the second oil grooves to receive oil therein is provided in the vanes.

2. The power steering oil pump as defined in claim 1, wherein the two or more of the second oil grooves are formed in parallel each other along a longitudinal direction of the end portion of the vanes.

3. The power steering oil pump as defined in claim 1, wherein the at least a first oil groove of the bush is circumferentially formed at a predetermined distance from each other along the inner circumference of the bush.

4. The power steering oil pump as defined in claim 1, wherein the at least a first oil grooves of the bush are spirally formed along on the inner circumference of the bush.

* * * * *